US005823163A

United States Patent [19]

Hoshi

[11] Patent Number: 5,823,163

[45] Date of Patent: Oct. 20, 1998

[54] INTAKE AIR-FLOW CONTROL DEVICE FOR AN INTERNAL COMBUSTION ENGINE

[75] Inventor: Koichi Hoshi, Susono, Japan

[73] Assignee: Toyota Jidosha Kabushiki Kaisha, Aichi, Japan

[21] Appl. No.: 820,138

[22] Filed: Mar. 19, 1997

[30] Foreign Application Priority Data

Mar. 27, 1996 [JP] Japan ..... 8-072601

[51] Int. Cl.[6] ..... F02D 09/02

[52] U.S. Cl. ..... 123/336; 123/179.18; 123/389

[58] Field of Search ..... 123/336, 389, 123/442, 179.16, 179.18

[56] References Cited

U.S. PATENT DOCUMENTS

| | | | |
|---|---|---|---|
| 4,308,837 | 1/1982 | Nohira et al. | 123/442 |
| 4,452,203 | 6/1984 | Oshika et al. | 123/403 |
| 4,479,472 | 10/1984 | Shimamura | 123/179.18 |
| 4,693,222 | 9/1987 | Itou et al. | 123/179.18 |
| 5,063,899 | 11/1991 | Hitomi et al. | 123/339 |
| 5,542,388 | 8/1996 | Ichinose et al. | 123/336 |
| 5,632,249 | 5/1997 | Sadakane et al. | 123/442 |

FOREIGN PATENT DOCUMENTS

| | | |
|---|---|---|
| 3609693 | 10/1986 | Germany . |
| 3530851 | 3/1987 | Germany . |
| 61-19968 | 1/1986 | Japan . |

OTHER PUBLICATIONS

Patent Abstracts of Japan, vol. 8, No. 164 (M–313), Jul. 28, 1984 & JP 59 060032 A (Toyo Kogyo), Apr. 5, 1984.
Copending U.S. Application Ser. No. 08/515,439.
Copending U.S. Application Ser. No. 08/515,883.

*Primary Examiner*—Tony M. Argenbright
*Assistant Examiner*—Hieu T. Vo
*Attorney, Agent, or Firm*—Kenyon & Kenyon

[57] ABSTRACT

An intake air-flow control device for an internal combustion engine is disclosed. The device comprises an intake air-flow control valve provided for every cylinder of the engine, a negative pressure actuator for opening the intake air-flow control valve from a partly opened condition to a fully opened condition when a negative pressure is supplied to the negative pressure actuator. When a current engine load becomes higher than a predetermined value, the negative pressure is supplied to the negative pressure actuator. During rapid acceleration, the predetermined value is changed to lower.

11 Claims, 3 Drawing Sheets

INTAKE AIR-FLOW CONTROL DEVICE FOR AN INTERNAL COMBUSTION ENGINE

BACKGROUND OF THE INVENTION

1. Filed of the Invention

The present invention relates to an intake air-flow control device for an internal combustion engine.

2. Description of the Related Art

Co-pending U.S. application Ser. No. 08/515,883 mentions an internal combustion engine in which an intake air-flow control valve is provided for every cylinder downstream of the surge tank. Such intake air-flow control valves are partly opened in low engine load operating conditions and are fully opened in high engine load operating conditions. Therefore, in low engine load operating conditions, a speed of intake air downstream of the intake air-flow control valve increases and the intake air flows into the cylinder along the wall of the intake port, so that strong vertical swirl is created in the cylinder. On the other hand, in high engine load operating conditions, a required large amount of intake air can pass through the intake port.

Here, the intake air-flow control valve is driven by a negative pressure actuator. When an engine operating condition varies from a low engine load operating condition to a high engine load operating condition, negative pressure is supplied to the negative pressure chamber of the actuator and thus the intake air-flow control valve is changed from a partly open condition to a fully open condition.

In the above prior art, to fully open the intake air-flow control valve, a pressure in the negative pressure chamber of the actuator must be dropped from the atmospheric pressure to a negative pressure. This requires a given period of time. Accordingly, when an engine operating condition varies rapidly from a low engine load operating condition to a high engine load operating condition in a rapid acceleration, a required large amount of intake air cannot pass through the intake port immediately and thus a vehicle response becomes slow at this time.

SUMMARY OF THE INVENTION

Therefore, an object of the present invention is to provide an intake air-flow control device for an internal combustion engine comprising an intake air-flow control valve provided for every cylinder of the engine and a negative pressure actuator for opening the intake air-flow control valve from a partly open condition to a fully open condition by a supplied negative pressure, which can prevent the above-mentioned slow vehicle response in rapid acceleration.

According to the present invention, there is provided an intake air-flow control device for an internal combustion engine comprising: an intake air-flow control valve provided for every cylinder of the engine; a negative pressure actuator for opening the intake air-flow control valve from a partly opening condition to a fully opening condition when a negative pressure is supplied to the negative pressure actuator; pressure control means for supplying the negative pressure to the negative pressure actuator when a current engine load becomes higher than a predetermined value; and changing means for decreasing the predetermined value in a rapid acceleration.

The present inventing will be more fully understood from the description of preferred embodiments of the invention set forth below, together with the accompanying drawings.

DESCRIPTION OF THE PREFERRED EMBODIMENTS

Figure 1:
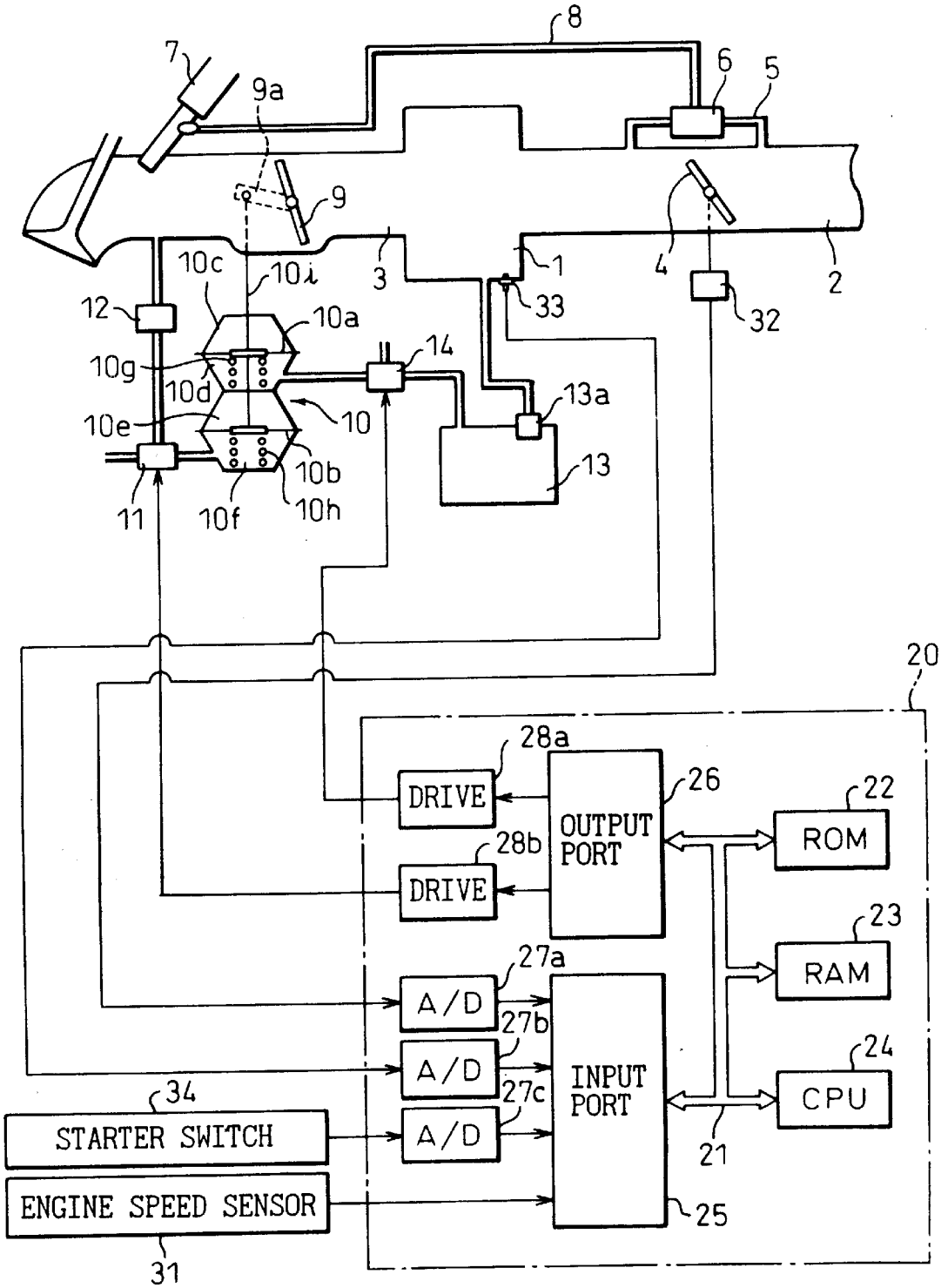
FIG. 1 is a schematic view of an intake system having an intake air-flow control device for an internal combustion engine according to the present invention.

FIG. 1 is a schematic view of an intake system, having an intake air-flow control device for an internal combustion engine, according to the present invention. In this figure, reference numeral 1 designates a surge tank, reference numeral 2 designates a single intake passage upstream of the surge tank 1, and reference numeral 3 designates an intake port communicating the surge tank 1 with each cylinder of the engine. A throttle valve 4 is arranged in the intake passage 2. Reference numeral 5 designates a bypass passage bypassing the throttle valve 4. An idle speed control valve (ISC valve) 6 is arranged in the bypass passage 5. The ISC valve 6 controls an amount of intake air so as to realize a required engine speed in an idle condition.

A fuel injector 7 is arranged in each intake port 3. An air leading passage 8 connects ISC valve 6 with a point close to the fuel injection hole of the fuel injector 7. Therefore, when a pressure at the point close to the fuel injection hole is negative, a part of required amount of intake air is led to the point close to the fuel injection hole by the air leading passage 8 and thus fuel injected by the fuel injector 7 can be atomized by the led air.

In each intake port 3, an intake air-flow control valve 9 is arranged upstream of the fuel injector 7. The intake air-flow control valve 9 is closed during engine starting, is partly opened in low engine load operating conditions, and is fully opened in high engine load operating conditions. During engine starting, although the throttle valve 4 is closed, a large amount of air exists in the surge tank 1 and the like downstream of the throttle valve 4 so that more intake air than the engine requires is usually supplied to the cylinder. Therefore, a large amount of fuel is required. However, combustion during engine starting is not perfect so that a large amount of HC and CO is discharged from the engine. Moreover, at this time, the purifying ability of the catalyst is usually low so that a large amount of HC and CO is discharged to the atmosphere. According to the present embodiment, during the engine starting, the intake air-flow control valve 9 is closed so that a required amount of intake air can be supplied to the cylinder, and thus the above-mentioned problem can be solved. Moreover, once the intake air-flow control valve 9 is closed, the speed of the intake air supplied to the cylinder becomes high so that fuel injected by the fuel injector 7 can be atomized by the intake air, and thus good combustion can be realized.

In general, each intake port 3 is vertically connected to a corresponding cylinder at the vicinity of the side wall thereof. Therefore, in low engine load operating conditions, once the intake air-flow control valve 9 is partly opened, the speed of the intake air supplied to the cylinder becomes high and the intake air flows into the cylinder at the vicinity of the side wall thereof along the wall of the intake port 3, so that strong vertical swirl can be created in the cylinder. Accordingly, at ignition, a strong turbulence of air-fuel mixture is created in the cylinder at an ignition timing so that combustion speed becomes high and thus good combustion can be realized. In high engine load operating conditions, the required amount of intake air becomes very large so that the intake air-flow control valve 9 is fully opened and thus a sufficient amount of intake air can be supplied into the cylinder.

Reference numeral 10 designates a two-stage type negative pressure actuator. The actuator 10 has four chambers in series, divided by first and second diaphragms 10*a*, 10*b*. The first chamber 10*c*, which is positioned in closest to the intake air-flow valve, is an atmospheric pressure chamber in which the atmospheric pressure is always supplied. The second chamber 10*d* which is positioned adjacent to the first chamber 10*c* is a negative pressure chamber into which a negative pressure is supplied when needed. The third chamber 10*e* which is positioned adjacent to the second chamber 10*d* is another atmospheric pressure chamber. The fourth chamber 10*f* which is positioned adjacent to the third chamber 10*e* is another negative pressure chamber. In the second chamber 10*d*, a first spring 10*g* is arranged to bias the first diaphragm 10*a* toward the first chamber 10*c*. In the fourth chamber 10*f*, a second spring 10*h* is arranged to bias the second diaphragm 10*b* toward the third chamber 10*e*. A operation rod 10*i* connected with the link 9*a* of the intake air-flow control valve 9 passes through the first chamber and is connected to the first diaphragm 10*a*. An extension of the operation rod 10*i* or another rod interconnects the first diaphragm 10*a* and the second diaphragm 10*b*.

The fourth chamber 10*f* of the negative pressure actuator 10 is connected to the intake port 3 downstream of the intake air-flow control valve 9 via a first changing valve 11 and a check valve 12. The check valve 12 only permits air to flow toward the intake port 3. Reference numeral 13 designates a vacuum tank connected to the surge tank 1 via a check valve 13*a*. The check valve 13*a* only permits air to flow toward the surge tank 1 so that the maximum negative pressure created in the surge tank 1 after the engine starts is accumulated in the vacuum tank 13. The second chamber 10*d* of the negative pressure actuator 10 is connected to the vacuum tank 13 via a second changing valve 14.

The first and second changing valves 11, 14 are, for example, solenoid valves. The first changing valve 11 supplies a negative pressure created in the intake port 3 downstream of the intake air-flow control valve 9 to the fourth chamber 10*f* in a turned-off condition, and supplies the atmospheric pressure to the fourth chamber 10*f* in a turned-on condition. The second changing valve 14 supplies a negative pressure in the vacuum tank 13 to the second chamber 10*d* in a turned-on condition, and supplies the atmospheric pressure to the second chamber 10*d* in a turned-off condition.

Figure 2:
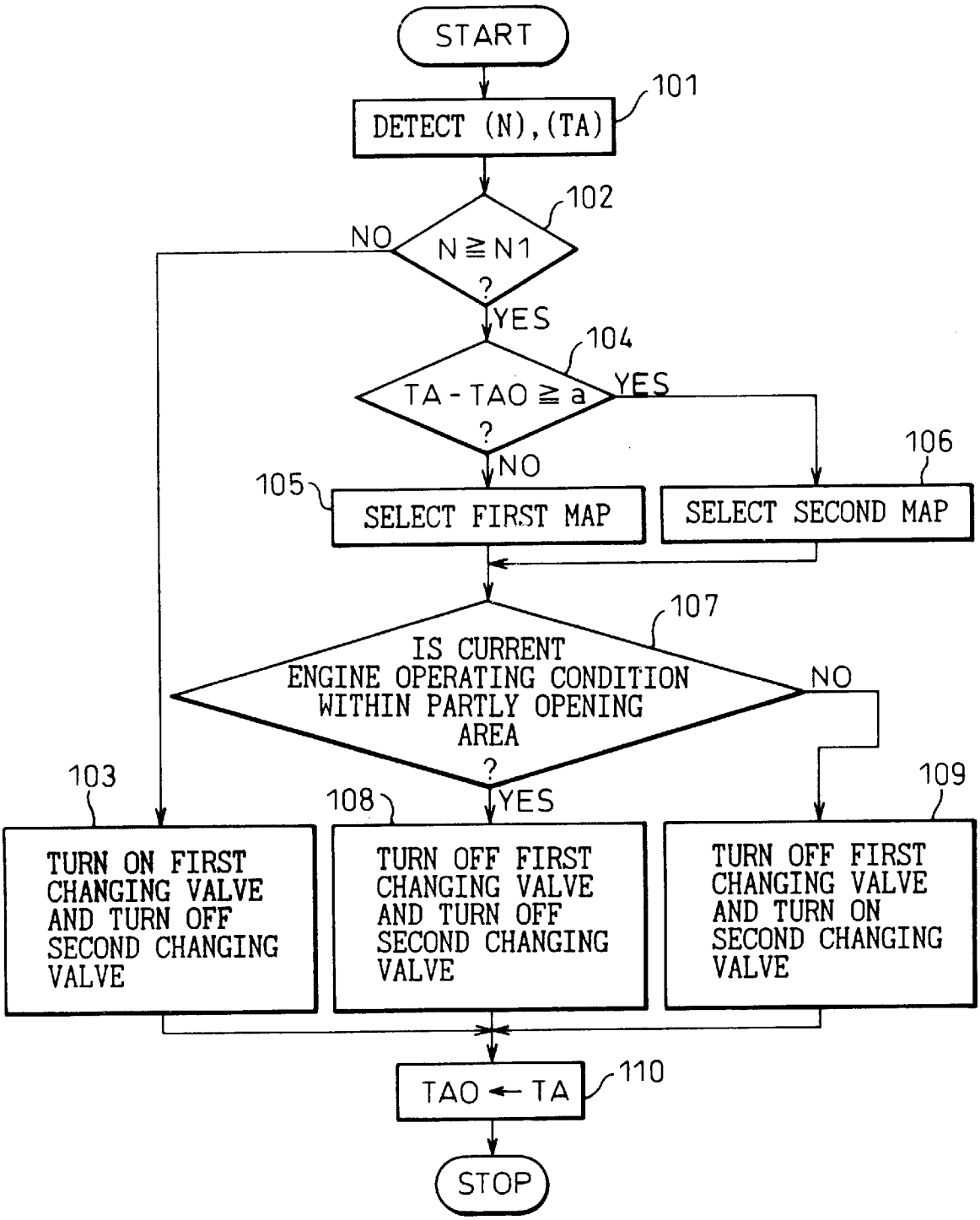
FIG. 2 shows a routine for controlling an intake air-flow control valve.

Reference numeral 20 is an electronic control unit which controls the first and second changing valves 11, 14, i.e., the intake air-flow control valve 9, according to a routine shown in FIG. 2. The ECU 20 is constructed as a digital computer and includes a ROM (read only memory) 22, a RAM (random access memory) 23, a CPU (microprocessor, etc.) 24, an input port 25, and an output port 26. The ROM 22, the RAM 23, the CPU 24, the input port 25, and the output port 26 are interconnected by a bidirectional bus 21. An engine speed sensor 31 for detecting the engine speed is connected to the input port 25. An throttle valve sensor 32 for detecting the degree of opening of the throttle valve 4 is connected to the input port 25, via an AD converter 27*a*. A pressure sensor 33 for detecting the pressure between the throttle valve 4 and the intake air-flow control valve 9 is connected to the input port 25, via an AD converter 27*b*. An engine starter switch 34 is connected to the input port 25, via an AD converter 27*c*. The output port 26 is connected to the first changing valve 11 via a drive circuits 28*a*. The output port 26 is also connected to the second changing valve 14 via a drive circuit 28*b*. The routine is started simultaneously with the engine starter switch turning on is repeated at every predetermined period.

First, at step 101, a current engine speed (N) and a current degree of opening of the throttle valve (TA) are detected. Next, at step 102, it is determined if the current engine speed (N) is higher than the engine speed (N1) in the completion of the engine starting. When the result is negative, i.e., when the engine is starting, the routine goes to step 103, and the first changing valve 11 is turned on and the second changing valve 14 is in turned off. Therefore, the atmospheric pressure is supplied to the second chamber 10*d* and the fourth chamber 10*f* of the negative pressure actuator 10 and thus the intake air-flow control valve 9 is closed. Next, the routine goes to step 110, the current degree of opening of the throttle valve (TA) is memorized as the degree of opening of the throttle valve at the last time (TA0). The routine is stopped.

Figure 3:
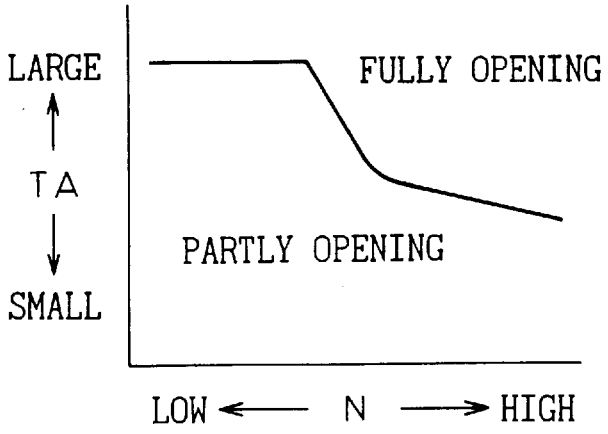
FIG. 3 is a first map used in the routine shown in FIG. 2.
Figure 4:
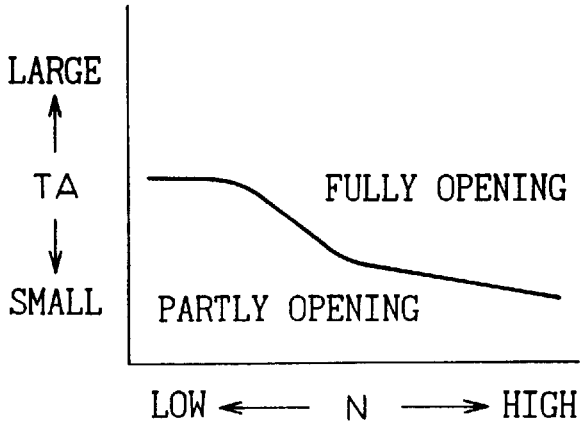
FIG. 4 is a second map used in the routine shown in FIG. 2.

On the other hand, when the result at step 102 is positive, i.e., after the completion of the engine starting, the routine goes to step 104 and it is determined if the difference between the current degree of opening of the throttle valve (TA) and the degree of opening of the throttle valve at the last time (TA0) is larger than a predetermined value (a) which represents an engine rapid acceleration condition. When the result is negative, i.e., when the engine is not in the rapid acceleration condition, the routine goes to step 105 and a first map shown in FIG. 3 is selected. On the other hand, when the result at step 104 is positive, i.e., when the engine is in the rapid acceleration condition, the routine goes to step 106 and a second map shown in FIG. 4 is selected.

Next, the routine goes to step 107 and, in the map selected at step 105 or 106, it is determined if a current engine operating condition on the basis of the current engine speed (N) and the current degree of opening of the throttle valve (TA) is within a partly opening area in which the intake air-flow control valve 9 is partly opened. When the result is positive, the routine goes to step 108, and the first changing valve 11 is turned off and the second changing valve 14 is turned off. Accordingly, a negative pressure created in the intake port 3 downstream of the intake air-flow control valve 9 is supplied to the fourth chamber 10*f* of the actuator 10 and the atmospheric pressure is supplied to the second chamber 10*d* of the actuator 10. Therefore, only the fourth chamber 10*f* contracts against the first and second springs 10*g*, 10*h* and thus the operation rod 10*i* displaces so as to partly open the intake air-flow control valve 9. Next, the process at step 110 is carried out and the routine is stopped.

On the other hand, when the result at step 107 is negative, the current engine operating condition is within a fully opening area in which the intake air-flow control valve 9 is fully opened and the routine goes to step 109. At step 109, the first changing valve 11 is turned off and the second changing valve 14 is turned on. Accordingly, a negative pressure created in the intake port 3 downstream of the intake air-flow control valve 9 is supplied to the fourth chamber 10*f* of the actuator 10 and a negative pressure in the vacuum tank 13 is supplied to the second chamber 10*d* of the actuator 10. Therefore, the second chamber 10*d* and the fourth chamber 10*f* contract against the first and second springs 10*g*, 10*h* and thus the operation rod 10*i* displaces so as to fully open the intake air-flow control valve 9. Next, the process at step 110 is carried out and the routine is stopped.

In both of the first and second maps, the higher the engine speed (N) on the boundary line between the partly opening area and the fully opening area is, the smaller the degree of opening of the throttle valve (TA), i.e., the engine load, becomes. However, a degree of opening of the throttle valve against an engine speed on the boundary line in the second map is always smaller than a degree of opening of the throttle valve against the same engine speed on the boundary line in the first map. Namely, the boundary line in the second map is positioned generally at the lower engine load side than the boundary line in the first map.

As the above-mentioned, to change the intake air-flow control valve 9 from the partly opened condition to the fully opened condition, a negative pressure must be supplied to the second chamber 10*d* of the actuator 10. For this purpose, the vacuum tank 13 is connected to the second chamber 10*d*. At this time, a given period of time is required for the air in the second chamber 10*d* to stop flowing out to the vacuum tank 13. During the given period of time, the intake air-flow control valve 9 has not yet opened fully. In the case of a gentle acceleration, when a current engine operating condition is within the fully opening area, it causes no problem when the first map is used to fully open the intake air-flow control valve 9. However, in the case of a rapid acceleration, if the first map is used to open fully the intake air-flow control valve 9, a sufficient amount of intake air cannot be supplied to the cylinder during the given period of time that the intake air-flow control valve 9 takes to fully open even though a large amount of intake air is required instantaneously, and thus a vehicle response becomes slow at this time. However, according to the present routine, in case of the rapid acceleration, the second map is used to open fully the intake air-flow control valve 9. Therefore, the intake air-flow control valve 9 starts to open at an engine load lower than when using the first map, so that when a large amount of intake air is actually required, the intake air-flow control valve 9 has already opened fully, and thus the slow vehicle response can be prevented. As above-mentioned, the partly opened condition of the intake air-flow control valve 9 causes good combustion due to the vertical swirl. Accordingly, in a case other than rapid acceleration, the intake air-flow control valve 9 does not start to open at the lower engine load so that an engine operating condition area in which good combustion due to the vertical swirl can be realized is not reduced.

When the engine is stopped, the routine is stopped simultaneously and the first and second changing valves 11, 14 are turned off. Accordingly, the atmospheric pressure is supplied to the second chamber 10*d* of the negative pressure actuator 10 and a pressure in the fourth chamber 10*f* is maintained at the negative pressure of the intake port 3 after the completion of the engine starting, and thus the intake air-flow control valve 9 is kept partly open while the engine is stopped. Therefore, if the intake air-flow control valve 9 has been fixed by freezing or the like while the engine is stopped, at the next engine start, the engine is prevented from stopping due to an insufficiency of intake air immediately after the engine has started, as might result were the intake air-flow control valve 9 kept closed.

When the engine starts again, the first changing valve 11 is turned on and the atmospheric pressure is supplied to the fourth chamber 10*f*, and thus the actuator 10 closes intake air-flow valve 9. As mentioned above, to change the pressure in the negative pressure chamber of the actuator from the atmospheric pressure to the negative pressure, a given period of time is required. However, to change a pressure in the negative pressure chamber of the actuator from the negative pressure to the atmosphere pressure, the negative pressure chamber is merely opened to the atmospheric and thus only a very short period of time is required. Therefore, according to the present embodiment, when the engine starts, the intake air-flow control valve 9 can be closed instantaneously, unlike the case where the intake air-flow control valve 9 is closed when the negative pressure is supplied to the negative pressure actuator. As mentioned above, during engine starting, while the intake air-flow control valve 9 opens, a large amount of HC and CO is discharged from the engine. However, according to the present embodiment, this can be prevented.

In the above-mentioned routine, the degree of opening of the throttle valve is utilized to detect the engine load and to detect rapid acceleration. However, a negative pressure detected by the above-mentioned pressure sensor 33 may be utilized to detect the engine load and to detect rapid acceleration. On the other hand, the engine speed is utilized to determine if the engine has started. However, an off-signal of the engine starter switch 34 may be utilized.

Although the invention has been described with reference to specific embodiments thereof, it should be apparent that numerous modifications can be made thereto by those skilled in the art, without departing from the basic concept and scope of the invention.

I claim:

1. An intake air-flow control device for an internal combustion engine including at least one cylinder, the intake air-flow control device comprising:

a first intake air-flow control valve for controlling an amount of intake air supplied to the at least one cylinder;

a first negative pressure actuator for opening the first intake air-flow control valve from a partly opened condition to a fully opened condition when a negative pressure is supplied to the first negative pressure actuator; and first pressure control means for supplying negative pressure to the first negative pressure actuator when a current engine load exceeds a predetermined value wherein, when an operating condition of the vehicle becomes a rapid acceleration condition, the predetermined value is reduced.

2. An intake air-flow control device according to claim 1, wherein the predetermined value varies in accordance with a current engine speed.

3. An intake air-flow control device according to claim 1, wherein the first pressure control means has a solenoid changing valve movable between a turned-on condition in which negative pressure is supplied to the first negative pressure actuator and a turned-off condition in which atmospheric pressure is supplied to the first negative pressure actuator.

4. An intake air-flow control device according to claim 1, wherein the engine includes a throttle valve provided in an intake air passage and wherein the first pressure control means has a tank coupled to the intake air passage downstream of the throttle valve to accumulate negative pressure therein, and wherein the first pressure control means supplies negative pressure from the tank to the first negative pressure actuator.

5. An intake air-flow control device according to claim 4, wherein the tank is connected to the intake air passage via a check valve.

6. An intake air-flow control device according to claim 1, wherein the first pressure control means further comprises a second negative pressure actuator for opening the first intake air-flow control valve from the closed condition to the partly opened condition when a pressure in negative pressure chamber of the second negative pressure actuator becomes negative, and a second pressure control means for supplying atmospheric pressure to the second negative pressure chamber during engine starting.

7. An intake air-flow control device according to claim 6, wherein the first and second negative pressure actuators are integrated.

8. An intake air-flow control device according to claim 6, wherein the another pressure control means supplies a negative pressure to said negative pressure chamber after the completion of the engine starting and maintains said negative pressure in said negative pressure chamber when the engine is stopped.

9. An intake air-flow control device according to claim 6, wherein the second pressure control means has a solenoid changing valve which supplies negative pressure to the negative pressure chamber in a turned-off condition and supplies atmospheric pressure to the negative pressure chamber in a turned-on condition.

10. An intake air-flow control device according to claim 6, wherein the engine includes a throttle valve provided in an intake air passage and wherein the second pressure control means has a connecting passage to supply negative pressure from a portion of the intake passage downstream of the throttle valve to the second negative pressure chamber.

11. An intake air-flow control device according to claim 10, wherein a check valve is arranged in the connecting passage.

* * * * *